US005339004A

United States Patent [19]

Murphy

[11] Patent Number: 5,339,004

[45] Date of Patent: Aug. 16, 1994

[54] REGULATING BALLAST WITH POWER FACTOR CORRECTION FOR HIGH-FREQUENCY GASEOUS DISCHARGE LAMPS

[75] Inventor: Pierce M. Murphy, LaCrosse, Wis.

[73] Assignee: First Lighting, Inc., St. Paul, Minn.

[21] Appl. No.: 80,994

[22] Filed: Jun. 22, 1993

Related U.S. Application Data

[63] Continuation of Ser. No. 771,004, Oct. 2, 1991, abandoned.

[51] Int. Cl.[5] ..... H05B 37/00

[52] U.S. Cl. ..... 315/244; 315/276; 315/232; 315/239; 315/DIG. 7

[58] Field of Search ..... 315/244, DIG. 7, 276, 315/232, 239

[56] References Cited

U.S. PATENT DOCUMENTS

| | | | |
|---|---|---|---|
| 4,353,011 | 10/1982 | Kaneda | 315/244 |
| 4,463,286 | 7/1984 | Justice | 315/244 |
| 4,847,537 | 7/1989 | Ueda | 315/244 |
| 4,933,605 | 6/1990 | Quazi et al. | 315/244 |
| 5,057,752 | 10/1991 | Grabner et al. | 315/244 |

*Primary Examiner*—Robert J. Pascal
*Assistant Examiner*—Reginald A. Ratliff

[57] ABSTRACT

A power regulating ballast for gaseous discharge lamps operated from a source of high-frequency power incorporates a method in an apparatus which utilizes a distributed capacitance in combination with an inductor and includes a current feedback derived from charges in the current flow through the lamp.

2 Claims, 1 Drawing Sheet

REGULATING BALLAST WITH POWER FACTOR CORRECTION FOR HIGH-FREQUENCY GASEOUS DISCHARGE LAMPS

This is a continuation of copending application Ser. No. 07/771,004 now abandoned filed on Oct. 2, 1991.

BACKGROUND OF THE INVENTION

1. Field of the Invention

This invention relates generally to apparatus and methods of operation of gaseous discharge lamps and is more particularly directed to methods and apparatus for the operation of gaseous discharge lamps in systems incorporating high-frequency energy.

2. Prior Art

In addition to the prior art cited in my issued U.S. Pat. No. 4,818,918 issued Apr. 4, 1989 for HIGH-FREQUENCY LIGHTING SYSTEM FOR GAS DISCHARGE LAMPS, I am aware of various and sundry lamp-ballast combinations which are and have been used in the high-frequency lighting field. I am unaware of any lamp/ballast which provides starting under below zero temperature conditions and the regulation and power factor characteristics of my invention as will be set forth below.

BRIEF DESCRIPTION OF THE INVENTION

A method and apparatus for practicing the method consist briefly of dividing a series resonant capacitor so that the total capacitance is provided by two capacitors, one of which bypasses the filament circuit of the gaseous discharge lamp while further providing a series inductor which is configured to provide a feedback proportional to the current flowing through the lamp.

Apparatus for implementing the method of my invention is typically incorporated in a lamp/ballast unit which is adapted to be connected in parallel with a plurality of similar units to a source of high-frequency power. Each of the lamp/ballast units typically includes a double filamented gaseous discharge lamp that is connected in parallel with a capacitor at like ends of the double filaments and in parallel with a further capacitor connected in series with an inductor secondary winding. An inductor primary winding is connected in series with the filaments and the entire unit, namely one end of one of the filaments and the other end of the inductor is connected in parallel with a source of high-frequency energy of nominal frequency of 28.5 KHz.

DESCRIPTION OF THE INVENTION

Figure 1:
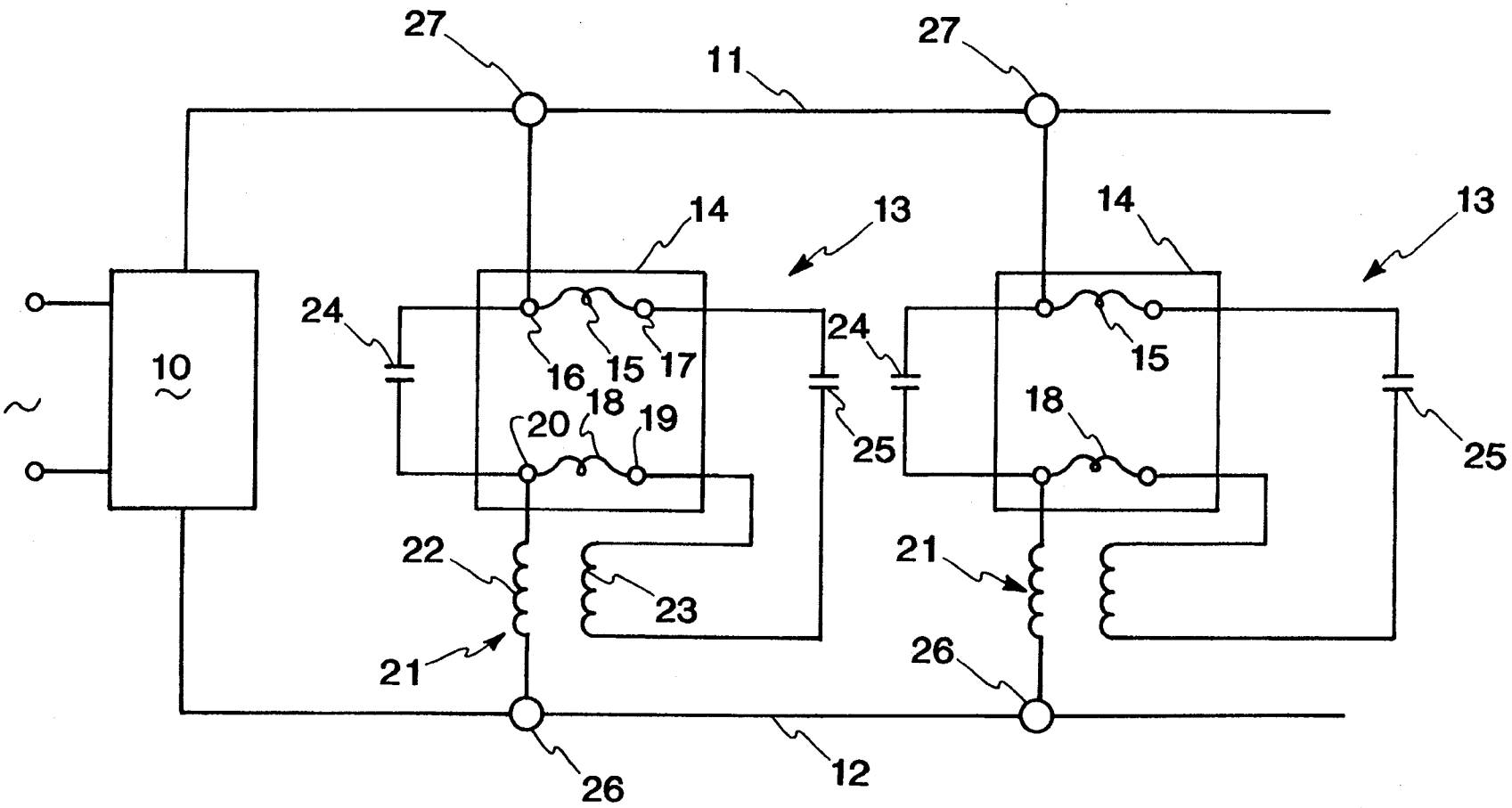
FIG. 1 is a schematic and diagrammatic representation of my invention embodied in a high-frequency lighting system.

Referring to the drawings, a high-frequency lighting system is shown comprised of a high-frequency power supply 10 connected through conductors 11 and 12 to a plurality of lamp/ballast units 13.

Lamp/ballast units include a gas discharge lamp 14 having a filament 15 with electrodes 16 and 17 and a second filament 18 with electrodes 19 and 20. An inductor 21 is shown having a primary winding 22 connected intermediate terminal 20 on filament 18 and terminal 27 connected to conductor 12. A capacitor 25 and the secondary winding 23 on inductor 21 are connected in series intermediate electrodes 17 and 19 on filaments 15 and 18, respectively. Capacitor 24 is connected intermediate terminals 16 and 20 on filaments 15 and 18, respectively. Terminal 16 is further connected to terminal 27, in turn, connected to conductor 11.

The following is a table of values of the components for successful operations for the range of lamp sizes indicated.

TABLE OF VALUES

| Lamp Size (watts) | | 5-9 | 13 | 18 | 26 |
|---|---|---|---|---|---|
| Ref. 22 | mH | 1.5 | 1.65 | 2.6 | 2.2 |
| Ref. 23 | turns | 15 | 25 | 15 | 25 |
| Ref. 24 | ufd | .0068 | .0056 | .0068 | .0033 |
| Ref. 25 | ufd | .012 | .015 | .0068 | .0082 |
| Nominal system | running voltage | 50 | 70 | 90 | 105 |
| RES f (nominal) | KHz | 30 | 27.3 | 26.7 | 31.6 |

OPERATION OF THE ILLUSTRATED EMBODIMENT

As may now be understood, the capacitance for starting is comprised of two components, namely the addition of the values of capacitors 24 and 25 which, approximate the sum of the values of each of the capacitors which then con. Dine with the inductor to provide a resonant frequency for the combination that is near the operating frequency (28.5 KHz) of a typical system. It may be noted that the sum of the capacitance of capacitors 24 and 25 is somewhat modified by the current feedback from the secondary 23 on inductor 21. Capacitor 24 further provides a power factor correction resulting in a sinusoidal ballast current that is substantially in phase with the square wave input voltage of the high-frequency source of power so that a power factor of substantially one is obtained.

Further, the secondary winding 23 on inductor 21 provides a feedback which is in opposition to current changes which may result from changes in the input voltage or from other causes, such as temperature effects on lamp characteristics and the like. This has been observed to provide a good regulation for lamp brightness at various levels above the twenty percent (20%) of full brightness area.

I claim:

1. A method of operating a high-frequency gas discharge lighting system comprising the steps of:

providing a plurality of gaseous discharge lamps, each having a first filament having first and second electrodes and a second filament also having first and second electrodes;

directly connecting a first capacitor between the first electrodes;

connecting one of said first electrodes to a source of high frequency and the other of said first electrodes through an inductive reactance, having feedback means, to said source of high frequency;

connecting a second capacitor and said feedback means on said inductive reactance between said second electrodes, said capacitors being of predetermined values the sum of which is resonant at the frequency of the lighting system and the values of said first capacitor and the inductor are related to combine to maintain a unity power factor.

2. A lamp/ballast for operation in a high frequency lighting system, comprising, in combination;

a plurality of gaseous discharge lamp means, each having first and second filaments each having first and second electrodes;

capacitive reactance means connected between said first electrodes;

a source of high frequency electrical energy having a first terminal, connected to a first electrode, and a second terminal;

inductive reactance means, including feedback means, connecting the other of said first electrodes to the second terminal on said source of energy; and means connecting further capacitive reactance means and said feedback means between said second electrodes.

* * * * *